United States Patent [19]

Chupka et al.

[11] 4,383,918

[45] May 17, 1983

[54] HIGH TURBULENCE SCREEN

[75] Inventors: David E. Chupka; Peter Seifert, both of Middletown, Ohio

[73] Assignee: The Black Clawson Company, Middletown, Ohio

[21] Appl. No.: 145,654

[22] Filed: May 2, 1980

[51] Int. Cl.[3] ..... B07B 1/20

[52] U.S. Cl. ..... 209/234; 209/273; 209/306

[58] Field of Search ..... 209/273, 305, 300, 379, 209/234; 210/415, 497 R, 497.1

[56] References Cited

U.S. PATENT DOCUMENTS

| | | | |
|---|---|---|---|
| 3,029,951 | 4/1962 | Cannon | 209/273 X |
| 3,584,685 | 6/1971 | Boyd | 210/497.1 X |
| 3,849,302 | 11/1974 | Seifert | 209/273 |
| 3,873,410 | 3/1975 | Chupka | 209/273 X |
| 3,909,400 | 9/1975 | Seifert | 209/273 X |
| 3,970,548 | 7/1976 | Seifert et al. | 209/273 X |
| 4,002,559 | 1/1977 | Paterson et al. | 210/415 X |
| 4,155,841 | 5/1979 | Chupka et al. | 209/273 |

FOREIGN PATENT DOCUMENTS

| | | | |
|---|---|---|---|
| 2812071 | 10/1978 | Netherlands | 209/306 |
| 6209 of 1832 | | United Kingdom | 209/393 |

*Primary Examiner*—Ralph J. Hill

*Attorney, Agent, or Firm*—Biebel, French & Nauman

[57] ABSTRACT

Apparatus for screening a suspension of liquid, paper making fibers and undesirable rejects to remove a substantial portion of the rejects therefrom comprise a cylindrical screening member provided with circumferentially extending screening slots in the range of from greater than 0.008 inch to approximately 0.030 inch in width, and bars projecting from the inlet face of the screen and cooperating with rotating foils for creating a field of high intensity, fine scale turbulence adjacent the inlet face of the screen. The paper making fibers and other particles of elongated thin shapes can pass through the screening slots, but relatively chunky reject particles, which would pass through the larger openings of conventional paper making screens, are rejected without fractionation of the paper making stock or appreciable variation in the consistencies of the feed, accepts and reject flows. The apparatus has special utility in a two-stage screening system when installed immediately ahead of the headbox of a paper machine, and also as the primary screen in a waste paper stock preparation system.

11 Claims, 7 Drawing Figures

HIGH TURBULENCE SCREEN

BACKGROUND OF THE INVENTION

Paper making stock requires screening before use on a paper making machine to remove undesirable particles (reject) which would otherwise show up as defects in the paper sheet, and which are too close in specific gravity to good paper making fibers for removal by centrifugal cleaning. These undesirable particles can conveniently be classified into two broad groups: (a) particles of elongated but thin shapes, such particularly as shives, splinters or slivers of wood, pieces of yarn or string, and flakes or strips of wet strength paper and plastic sheet or film, and (b) relatively chunky particles, such as bits of rubber or foamed plastic, fragments of bark, and system debris.

The particular types of these two groups of reject particles vary depending on the nature of the paper making stock. Thus in the case of virgin pulp at the beater room stage, the most prevalent of the group (a) particles would usually be shives or splinters, while the group (b) particles would usually be bits of bark. In waste paper furnishes, there are unlikely to be any significant quantity of shives at the beater room stage, but there will be substantial amounts of string, wet strength paper and plastic sheet and film, while the group (b) particles may be of any of a wide variety of contaminates, particularly bits of foamed plastic, rubber and hard plastic.

All types of furnishes are also subject to accumulation of system debris between the beater room and the paper machine, such for example as bits of the system itself (pipe-lining material, scale, etc.) and material which falls into a chest or other open part of the system, such as hard plastic safety hats which are gradually reduced to small particles in a pump.

It has become increasingly important in paper making to screen the stock immediately ahead of the head box as the paper industry has in recent years tended toward the use of increasingly narrow slice openings from the head box. This is especially true in pressure formers on tissue machines wherein extended slice passages as narrow as 0.03 inch are not uncommon, and any chunky particles having one or more dimensions greater than the slice width are likely to jam therein and cause disruption of the stock flow onto the breast roll. This problem is also accentuated by the increasing use of substantially higher consistency stock at the slice, namely consistencies as high as 4% solids.

It has accordingly been a common practice for some years in the paper industry to install one or more pressure screens immediately ahead of the head box, and this practice has become more common in response in the increased use of narrower slice openings. Until the present invention, however, there was no screen available to the industry which solved all the related problems.

More specifically, if the screening member of a pressure screen were provided with circular screening holes of sufficiently small diameter to reject particles significantly smaller than e.g. 0.062 inch in cross-section, it not only would reject a substantial quantity of good long fiber, but it would also have an impractically low capacity and unacceptably high power requirements. In addition, the smaller the holes in such a screen, the greater are the power requirements for the pump or pumps by which the stock is fed through it to the head box.

The use of previously available screens incorporating a slotted screen member has other disadvantages. Screens such as are disclosed in Seifert U.S. Pat. No. 3,849,302, wherein the slots extend axially of the screening cyclinder, are extremely effective for rejecting elongated thin contaminate particles, but they also tend to reject a substantial number of the long fibers. In fact, the effectiveness of such screens for fractionating fiber stock by length of fiber is disclosed and claimed in Seifert U.S. Pat. No. 3,909,400, and it is necessary to maintain the feed stock at low consistency, i.e. not substantially greater than 1%, to minimize the tendancy to fractionation, which increases markedly as the consistency is increased.

Slotted screens of the construction disclosed in our U.S. Pat. No. 4,155,841, wherein the slots extend circumferentially of the screening cylinder, do not have the fractionating effect of slotted screens wherein the slots extend axially of the screening cylinder, and they are highly effective for fine screening purposes when they follow a screen which removes the elongated thin contaminate particles. Such screens, however, wherein the maximum width of the slots is disclosed and claimed as 0.008 inch, are of relatively low capacity under economical conditions of power consumption, and they have not been proved capable of effectively handling stock of higher consistency than the slotted screens of the Seifert patent. Their use immediately ahead of a paper machine would therefore be impractical.

SUMMARY OF THE INVENTION

As noted in the preceding paragraph, our above U.S. Pat. No. 4,155,841 is limited to screens having slots extending circumferentially of the screening cylinder wherein the width of the slots is in the range of 0.001 to 0.008 inch, and it was our belief when the application for that patent was filed that the practical upper limit for the slot width was not greater than 0.008 inch.

We have now discovered that a variety of unexpected and highly advantageous results are obtained with screens constructed as disclosed in that patent except that the circumferentially extending slots are of substantially greater width, i.e. up to widths as great as 0.030 inch. The resulting screens have outstanding advantages for use in two-stage screening of paper making stock, particularly when the screen of the present invention is installed immediately ahead of a paper machine head box, and they are also advantageous for use as the primary screen in a waste paper stock preparation system.

These unexpected and advantageous results lie in the areas of capacity, power requirements and the ability to handle effectively consistencies as high as the maximum capable of being pumped, e.g. as high as 10% solids. This last factor has very important collateral advantages, in that the screens of the present invention do not require that the stock supplied to them be diluted to low consistency for screening and then subsequently thickened for the next stage of treatment or use. Thus the installation of one or more screens of the present invention can eliminate the necessity of thickener apparatus downstream therefrom.

This last feature offers particular advantages when a screen of the present invention is used in the preparation of waste paper furnishes, which commonly contain substantial quantities of elongated thin contaminates, particularly pieces of plastic sheet and film, but also substantial quantities of more or less cubical contaminate particles.

Tests indicate that if a screen of the present invention is used in a system such as is shown in Chupka U.S. Pat. No. 3,873,410 as the primary screen following the cyclone which removes high specific gravity contaminate particles from the stock extracted from a waste paper pulper, particularly if the stock is at a relatively high consistency for screening, e.g. 3% or more, substantial quantities of thin plastic pieces are rejected along with the chunky reject particles too large to pass through the screening slots. Apparently the operation of the screens of the invention is such, by reason of the degree of turbulence created on the inlet side of the screening member, as to tend to prevent many of such elongated thin contaminates from lining up with the slots and thereby to cause such contaminates to remain with the other reject materials.

In the matter of capacity, there are outstanding differences between screens of the present invention and those of our prior patent. For example, in the screen of the patent wherein the slots are 0.005 inch wide, operating at 650 rpm with stock at 1.2% consistency, the maximum capacity was approximately 23 tons per day of accepted stock on a bone dry basis. Under the same conditions with screening cylinders of the invention having slot widths of 0.014, 0.018 and 0.022 inch respectively, the capacity rose to 220, 260 and 280 tons per day, and would have been substantially higher except that the pump available for the test runs was operating at its own output limit.

It is of course apparent that the open area of the screening cylinders increases with slot width, but tests have established that the increase in capacity is unexpectedly much greater than in proportion to the increase in open area. For example, with the four screens tested as noted in the preceding paragraph, the cylinder with 0.005 inch wide slots had 1.91% open area, while the open areas for the other three screens were 5.34%, 6.86% and 8.34% respectively. Thus the ratios of the open areas of the larger slot cylinder to the smallest slot cylinder were 2.80, 3.60 and 4.40 respectively, but the corresponding ratios of capacity were 4.83, 5.72 and 6.14 respectively and would have measured substantially higher if there had been available pumping capacity to satisfy the through flow capacity of the screens of the invention.

Based on the results summarized above which were obtained without approaching the capacity limits of the screens of the invention, it is anticipated that with adequate pumping capacity, the capacity of the screens of the invention will exceed, by factors of two or substantially more, the capacity predicted on the basis of screens having slots of the low width range disclosed in our above patent.

It is also important on this matter of capacity that the screens of the invention showed far greater capacity under the same test conditions than screens in accordance with the above Seifert U.S. Pat. No. 3,849,302 having axially extending slots of the same respective widths. More specifically, whereas in all three cases the ratio of the open areas of the screens of the invention to those with axially extending slots was approximately 1.25, i.e. only 25% greater open area, the ratios of the measured capacities were 3.93, 4.33 and 3.11 respectively, i.e. an average of almost 400% greater. Further, the screens having axial slots were operating at their maximum capacities, whereas the screens of the invention were operating at significantly less than maximum capacity by reason of the limited pumping capacity as explained above.

On the matter of power requirements, the screens of the present invention offer advantages in two ways. First, tests have established that the screens of the invention require significantly lower rotor speeds, and hence significantly less horsepower, to produce the same through flow of accepted stock as axially slotted screens such as are disclosed in the above Seifert patent.

As a specific example of this feature, in one test under the same conditions of a screen installed immediately ahead of a paper machine head box, a screen in accordance with the Seifert patent having axially arranged slots 0.018 inch wide required a rotor speed of 650 rpm and more than 55 horse-power for a desired capacity. A screening cylinder in accordance with the invention, having slots 0.014 inch wide, installed in the same position operated at the same capacity at a rotor speed of 450 rpm and 30 horsepower, and the results were so satisfactory as to justify the prediction that equally good results can be obtained at still lower speeds and power requirements.

Even more significant and unexpected is that based on all test results as of the filing of this application, a screen of the invention wherein the screen slots are 0.018 inch wide will handle satisfactorily stock of as high as 7% consistency at a rate of 1000 tons per day and at the same rotor speed as a screen of the above Seifert patent handling 1.2% consistency stock at a rate of 60 tons per day.

The other significant way in which the invention promotes energy saving is in the power required for the pump or pumps feeding the screens. Thus in the specific example noted in the preceding paragraph, using the same pump and horsepower, there was a pressure drop of between two and three pounds through the screen equipped with axially extending slots, whereas with the screen of the invention, there was an increase of two pounds in pressure through the screen.

In another example, a screen of the construction shown in Seifert U.S. Pat. No. 4,105,543, wherein the screen cylinder had circular holes 0.079 inch in diameter, was replaced by a screen of the present invention having slots 0.018 inch wide. Notwithstanding the fact that the open area of the slotted screen cylinder was only 6.86% as compared with 15% open area for the screen with circular holes, the flow conditions through the screen changed from a pressure drop of one pound to an increase of one pound for the same horsepower and a higher through flow.

There is therefore an important correlation between the advantages afforded by screens of the invention in that their greatly increased capacity and ability to handle effectively stock of much higher consistencies as compared with prior screens, including those of our above patent, are directly reflected in significantly reduced cost per ton of paper and equally significant saving of energy. Further, these advantages are also accompanied by the ability of the screens of the invention to screen paper making stock with minimal fractionation and maintenance of essentially the same consistency conditions in both the accepts and reject flows therefrom.

DESCRIPTION OF THE PREFERRED EMBODIMENTS

Figure 1:
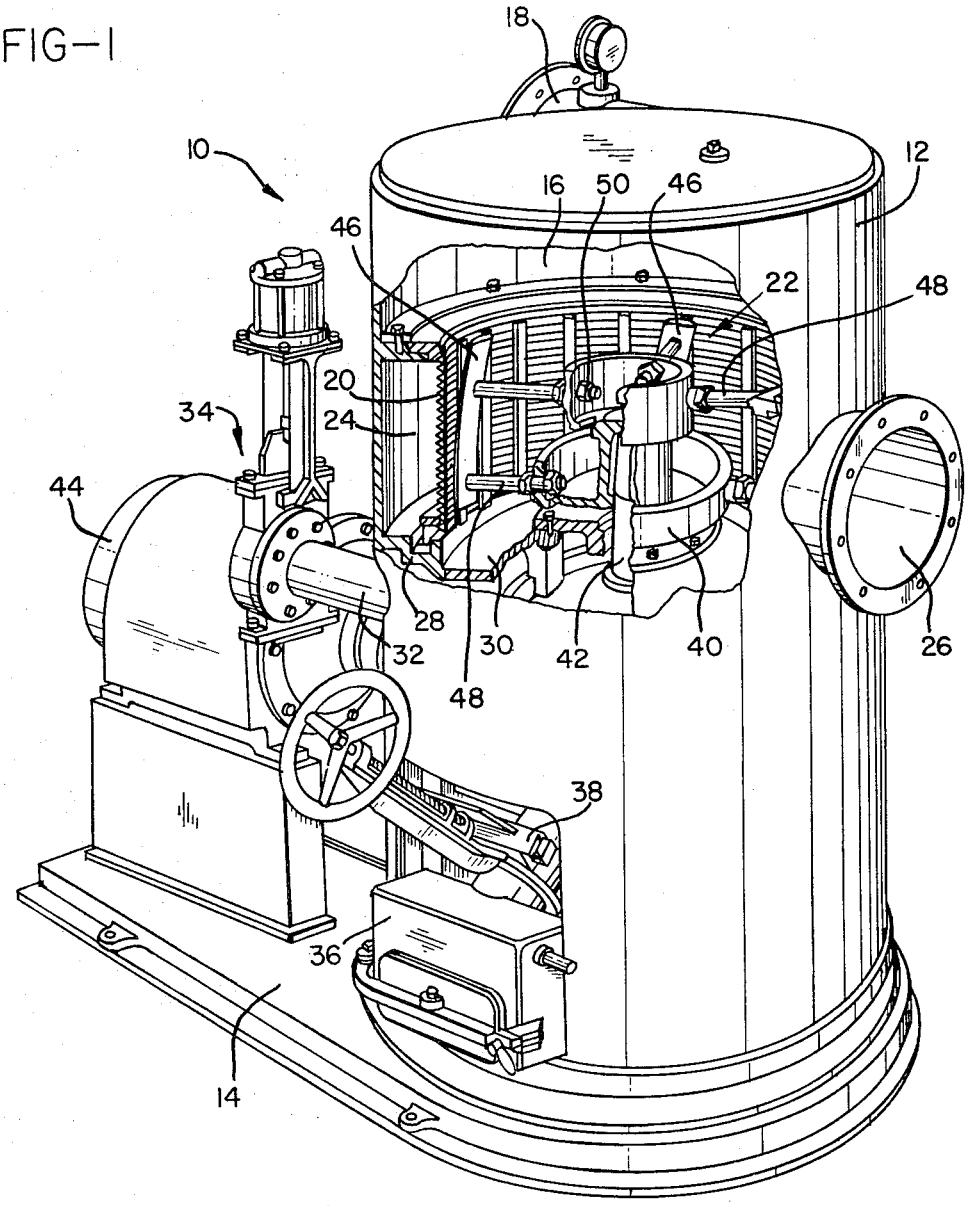
FIG. 1 is a perspective view of screening apparatus in accordance with the present invention.

The screening apparatus 10 shown in FIG. 1 is similar to that shown in the above noted Seifert U.S. Pat. No. 3,849,302 except for the incorporation of the screening cylinder of the present invention, and it includes a main housing 12 on a base 14. An inlet chamber 16 at the upper end of the housing has a tangential inlet port 18 through which the paper making stock is fed under pressure into the housing.

The screening cylinder 20 of the present invention is positioned within the housing 12 such that it divides the interior of the housing into a central inlet or screening chamber 22 into which the stock is initially fed, and an accepts chamber 24 communicating with an outlet port 26.

The bottom wall 28 of the screening chamber 22 includes a trough 30 communicating with a discharge port 32 controlled by a valve assembly 34 which, as is conventional, can be preset to provide a desired continual or periodic bleed of rejects from the system. The reject particles which collect on trough 30 drop therefrom into a collection box 36 upon opening of the manually controlled valve 38.

A rotor 40 supported on a drive shaft 42 in the screening chamber 22 is driven by a motor 44 and suitable interconnecting gearing or the like. The rotor 40 carries vanes or foils 46 mounted on the ends of support rods 48 which are provided with adjustable connections 50 to position the foils as desired with respect to the inner face of the screening cylinder 20.

Figure 2:
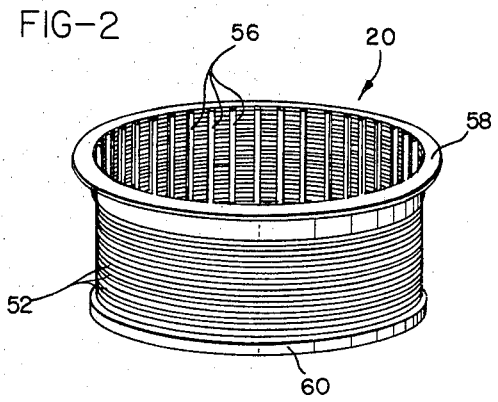
FIG. 2 is a perspective view of a screening cylinder in accordance with the present invention.
Figure 4:
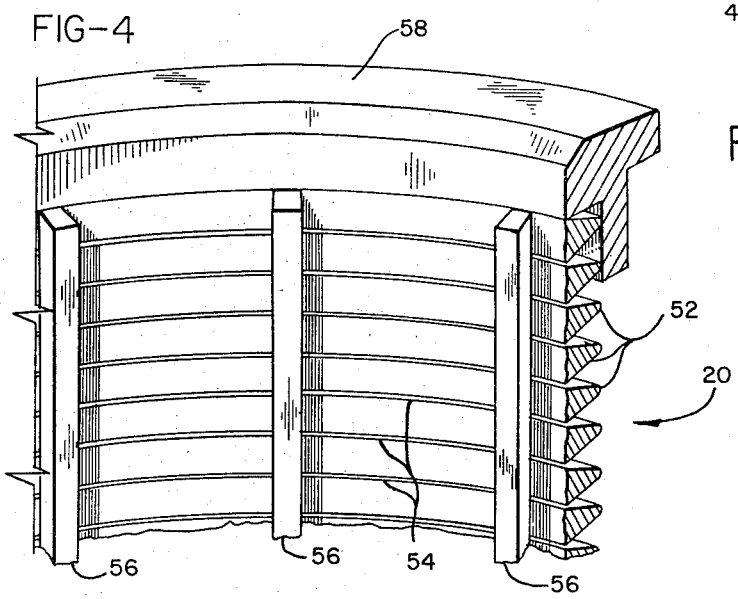
FIG. 4 is an enlarged view of a portion of the inside of the screening cylinder of FIG. 2.

As best seen in FIGS. 2 and 4, screening cylinder 20 includes a series of rings 52 which can conveniently be formed from generally triangularly cross-sectioned wire strand having a base width of 3/16 inch and an altitude, which establishes the thickness of the cylinder 20, of approximately 11/32 inch, although it will be apparent that other means, such as annular discs, can be used to achieve the same results, and it is also theoretically possible to machine the desired slots in the wall of an initially imperforate hollow cylinder.

The rings 52 are initially laid up in a suitable jig in which the rings are spaced as necessary to provide slots 54 of the desired width. Thereafter, bars 56 are secured to the inner face of the cylinder by welding or the like, and mounting rings 58 and 60 are similarly secured to the upper and lower ends of the cylinder. The resulting structure is a screening cylinder having slots 54 extending circumferentially thereof and of a desired minimum width, and bars 56 projecting inwardly of the inner face of the cylinder.

As explained above, the preferred range of slot widths is from 0.014 to 0.022 inch, but it may be extended to between 0.008 and 0.010 inch on the low side or as high as 0.030 inch. Thus if the screen is to be installed ahead of a slice opening 0.032 inch wide, as is now commonly used, the screening slots may be as wide as 0.030 inch to assure rejection of all chunky particles capable of jamming in the slice opening. Generally, however, it presently appears that the maximum usage for screens of the invention will be for installations where slot widths in the 0.014 to 0.022 inch range will most effectively accomplish the purpose of the user.

It will be apparent that with the slots 54 extending continuously circumferentially of the screening cylinder, there are no slot ends on which fibers can hairpin, and it is also important that the bars 56 be of sufficient section to obviate the possibility of the hairpinning of fibers around them. Preferably, therefore, the bars should be at least $\frac{1}{8}$ inch thick measured radially of the cylinder 20 and at least that thick in the tangential dimension. The maximum practical limit for these dimensions is approximately $\frac{1}{2}$ inch, and in the tests described above, the bars were $\frac{1}{4}$ inch square in cross-section.

Figure 3:
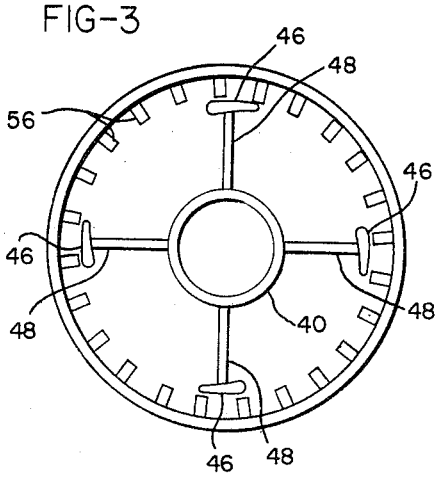
FIG. 3 is a plan view of the screening cylinder of FIG. 2 showing its relationship to rotating foils positioned within the screen.

When the screen cylinder 20 is mounted in the housing 12 as shown in FIG. 1, the foils 46 of the rotor 40 cooperate with the inwardly projecting bars 56 as seen in FIG. 3 to create a field of high intensity fine scale turbulence adjacent the inner face of the screen. This action promotes a true particle size separation and practical screening on a scale heretofore considered impractical and uneconomic and it is especially effective, particularly at higher consistencies, in preventing relatively long pieces of plastic sheet and fiber from lining up sufficiently with the screening slots 54 to pass therethrough.

Figure 5:
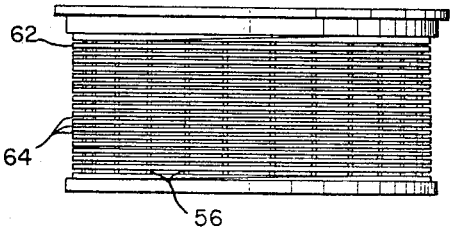
FIG. 5 is an elevational view showing a modified form of screening cylinder in accordance with the invention.

In the embodiments shown in FIGS. 2 and 4, the screening cylinder 20 is shown as formed of a series of rings spaced axially to provide the screening slots 54. Alternately, a single continuous wire strand 62 may be utilized, as shown in FIG. 5, wound helically about a central axis with adjacent turns spaced from each other to provide slots 64 of the desired width. As in the embodiment of FIGS. 2 and 4, longitudinally extending bars 56 are utilized to position adjacent turns of the wire 62 and to serve as the inward projections which cooperate with foils 46 to generate the field of high intensity, fine scale turbulence adjacent the inner face of the screen cylinder.

Figure 6:
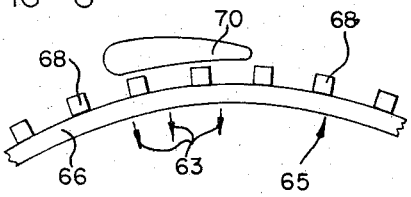
FIG. 6 is a fragmentary plan view similar to FIG. 3 and showing a modification of the screening apparatus of the invention.

In the embodiments shown in FIGS. 1 through 5, the inlet face of the screening cylinder is its inner face. As will be apparent from FIG. 6, the invention is applicable to screens wherein the outer face of the screen cylinder is its inlet side, so that the accepted stock represented by the arrows 63 flows radially inwardly of the slotted cylinder 65. In this embodiment, the inlet face of the cylinder 65 is its outer face 66, bars 68 are positioned on the outer face of the cylinder, and foils 70 rotate past the outer face of the cylinder.

Figure 7:
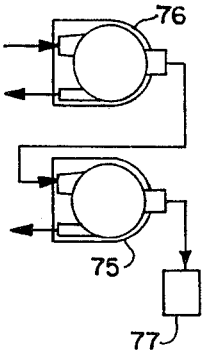
FIG. 7 is a diagrammatic view of a two-screen system in accordance with the invention.

FIG. 7 illustrates the use of a slotted screen 75 in accordance with the invention in series between a similar screen 76 having circular screening holes and a further station 76, such as the headbox of a paper machine. For such uses, as previously pointed out, the screen 76 should have circular holes large enough to accept substantially all useable fiber, and therefore large enough to pass chunky contaminant particles capable of jamming the slice opening of the headbox. The screen 75 of the invention, however, should have slots having their narrowest portion of a predetermined width substantially smaller than the diameter of the holes in the screen 76, and preferably also of a width narrower than the slice opening of the headbox in order to reject chunky particles large enough to jam the slice opening.

While the apparatus of the present invention is shown in FIGS. 1 and 3 as including bars and rotating foils to produce the high intensity field of turbulence adjacent the screen inlet face, it will be appreciated that other means of creating such turbulence can be utilized to the same effect within the scope of the present invention.

While the forms of apparatus herein described constitute preferred embodiments of the invention, it is to be understood that the invention is not limited to these precise forms of apparatus, and that changes may be made therein without departing from the scope of the invention.

What is claimed is:

1. A pressurized paper making stock screen comprising:

a substantially cylindrical screening member having an inlet side and an accepts side, means for feeding under pressure a suspension of liquid, paper making fibers and undesirable reject particles to said inlet side of said screening member, means defining a plurality of through slots in said screening member extending substantially circumferentially thereof, said slots having a narrowest portion of from greater than 0.008 inch to approximately 0.030 inch, means for generating immediately adjacent said inlet side of said screening member a field of high intensity fine scale turbulence, and means for removing from said screen rejects too large to pass through said slots.

2. The screen of claim 1 wherein said turbulence generating means comprises:

elongated members projecting from said inlet side of said screening member, and means mounted for movement adjacent and parallel with said inlet side of said screening member and said elongated members, said elongated members being of sufficiently large section measured transversely of said cylinder to prevent hairpinning of fibers thereon.

3. The screen of claim 2 wherein said slots are circumferentially continuous about said screening member and spaced axially thereof.

4. The screen of claim 3 wherein said screening member comprises a plurality of axially spaced rings defining said slots therebetween.

5. The screen of claim 3 wherein said screening member comprises a continuous strand wound helically about a central axis with adjacent coils in spaced relation defining said slots therebetween as a substantially continuous helical slot.

6. A system for treating on a continuous basis a suspension comprising liquid, paper making fibers of various lengths, and undesirable particles of both elongated but thin shapes and relatively chunky shapes to remove a substantial portion of said particles from said suspension as reject, comprising:

(a) a pair of screening stations arranged to receive said suspension in series, (b) the first of said screening stations including means for rejecting the undesirable particles of elongated but thin shape while accepting the particles of relatively chunky shape having cross-sectional dimensions less than a first predetermined maximum, and (c) the second of said screening stations being connected to receive the accepted stock from said first screening station and including means for rejecting particles of relatively chunky shape having cross-sectional dimensions greater than a second predetermined maximum substantially smaller than said first predetermined maximum while accepting particles of elongated but thin shape.

7. A system as defined in claim 6 wherein said first screening station includes a screen member provided with multiple screen holes of substantially circular shape and a predetermined diameter establishing said first predetermined maximum dimension, and said second screening station includes a cylindrical screening member provided with multiple screening slots extending substantially circumferentially thereof and of substantially greater length than width, said slots having a narrowest portion of a predetermined width substantially smaller than the diameter of said holes to establish said second maximum predetermined dimension and reject relatively chunky particles having a cross-sectional dimension greater than said second predetermined maximum.

8. A system as defined in claim 6 wherein said second screening station includes a screen comprising:

a substantially cylindrical screening member having an inlet side and an accepts side, means for feeding under pressure a suspension of liquid, paper making fibers and undesirable reject particles to said inlet side of said screening member, means defining a plurality of through slots in said screening member extending substantially circumferentially thereof, said slots having a narrowest portion of from greater than 0.008 inch to approximately 0.030 inch, means for generating immediately adjacent said inlet side of said screening member a field of high intensity fine scale turbulence, and means for removing from said screen rejects too large to pass through said slots.

9. A system as defined in claim 8 wherein said second screening station further comprises:

elongated members projecting from said inlet side of said screening member, and means mounted for movement adjacent and parallel with said inlet side of said screening member and said elongated members, said elongated members being of sufficiently large section measured transversely of said cylinder to prevent hairpinning of fibers thereon.

10. A system as defined in claim 8 wherein said first screening station includes a screen member provided with multiple screen holes of substantially circular shape and a predetermined diameter establishing said predetermined maximum dimension.

11. A system as defined in claim 9 wherein said first screening station includes a screen member provided with multiple screen holes of substantially circular shape and a predetermined diameter establishing said first predetermined maximum dimension, and wherein said slots in said screening member at said second screening station are circumferentially continuous about said screening member and spaced axially thereof.

* * * * *